United States Patent [19]

Lindenberg et al.

[11] Patent Number: 5,056,842

[45] Date of Patent: Oct. 15, 1991

[54] MANUAL COLLECTION APPARATUS

[76] Inventors: Judith C. Lindenberg, 812 Monte Leon Dr., Beverly Hills, Calif. 90210; Avinoam S. Zerkowitz, 6226 Pat Ave., West Hills, Calif. 91307

[21] Appl. No.: 421,813

[22] Filed: Oct. 16, 1989

[51] Int. Cl.[5] ..... A01K 29/00; E01H 1/12

[52] U.S. Cl. ..... 294/1.4; 294/19.1; 294/115

[58] Field of Search ..... 294/1.3–1.5, 294/19.1, 25, 50.8, 55, 115; 15/104.8, 257.1, 257.6, 257.7; 220/1 S, 902, DIG. 11, DIG. 12; 229/2.5 R, 3.5 R, 902, DIG. 13

[56] References Cited

U.S. PATENT DOCUMENTS

| | | | |
|---|---|---|---|
| 3,446,525 | 5/1969 | Jones | 294/1.4 |
| 3,733,098 | 5/1973 | Tobias | 294/1.4 |
| 3,738,697 | 6/1973 | Kahan | 294/1.4 |
| 3,929,363 | 12/1975 | Kahan | 294/1.4 |
| 4,014,584 | 3/1977 | Bau | 294/1.4 |
| 4,056,278 | 11/1977 | Bau et al. | 294/1.4 |
| 4,148,510 | 4/1979 | Brack et al. | 294/1.3 |
| 4,200,319 | 4/1980 | Cooper | 294/1.4 |
| 4,247,139 | 1/1981 | Grieb | 294/1.4 |

FOREIGN PATENT DOCUMENTS

| | | | |
|---|---|---|---|
| 3521997 | 1/1987 | Fed. Rep. of Germany | 294/1.3 |
| 2497849 | 7/1982 | France | 294/1.3 |
| 2611431 | 9/1988 | France | 294/1.4 |

*Primary Examiner*—Johnny D. Cherry
*Attorney, Agent, or Firm*—Henry M. Bissell

[57] ABSTRACT

Apparatus for facilitating the collection and disposal of solid pet wastes. It includes a long-handled reciprocable implement having a pair of jaws at the distal end and a pair of handles at the proximal end connected to open and close the jaws. A disposable container having a pair of clamshell-shaped halves adapted to releasably receive mating retaining portions of the jaws is adapted to be manipulated by the jaws so as to open and close while picking up pet waste deposits. When it is ready for disposal, the edges of the container are secured together and manipulation of the jaws releases the container for dropping into a waste repository.

13 Claims, 4 Drawing Sheets

MANUAL COLLECTION APPARATUS

BACKGROUND OF THE INVENTION

1. Field of the Invention

This device is intended for, though not limited to, the collection and subsequent disposal of small domestic animal solid refuse, and is related to those devices employing a long handled scoop or shovel, with or without a fixed or removable receptacle.

2. Description of the Related Art

A wide variety of methods and devices have long been employed for the unpleasant task of collecting and disposing of domestic animal solid wastes. With more and more communities passing ordinances and levying fines for failure of pet owners to adequately collect and dispose of their pet's excrement, the need for a simple, clean, and efficient method of compliance is clearly demonstrated.

Current methods in general use involve collection with paper towels, plastic bags, rubber gloves, trowels, long handled scoops, shovels, or almost any combination of the above. Disadvantages are present with all of the aforementioned. The direct (or hands-on) approach brings the pet owner into tactile and olfactory contact with the offending matter, a prospect deemed unpleasant by many as evidenced by the vast number of scoop-type devices sold in pet stores. These scoops only postpone the unpleasantness, for the scoop itself comes in contact with the waste and then requires careful handling and subsequent cleaning.

An example of a typical prior art solution to the problem may be found in the refuse retrieval device of the Hastings U.S. Pat. No. 4,248,468. While this device makes the pet waste pick-up task more convenient by enabling it to be performed remotely, without stooping, it is still subject to the disadvantage of the scoops described above, in that it must be carefully cleaned of the residue of collected waste before it is stored until further use, or it will result in the offensive odors and dirt being brought inside from outdoors. Like all of the other known prior arrangements, this device does not provide for collection in a disposable container, which is really the only completely satisfactory solution to the problem.

None of the currently available devices or methods which are known is as satisfactory in use as the invention disclosed herein. This device fills a long-felt need, for it eliminates contact with the waste on the part of both the operator pet owner and the reusable portion of the collection device, all the while collecting and packaging the waste in a sealable container for convenient disposal.

SUMMARY OF THE INVENTION

In brief, arrangements in accordance with the present invention provide for the collection and packaging for subsequent disposal of solid pet wastes by way of a remotely and manually operated, reusable pair of jaws mounted at the end of a shaft. At the end opposite the jaws are a pair of handles, providing the means of carrying the device and of operating the jaws. The jaws are specially shaped to hold and manipulate a sealable, disposable container formed of styrofoam or some similar material. The jaws manipulate the container by means of a protrusion in the form of a ridge, running along the outer surface of the inside of each jaw and angled slightly inward (much like a row of teeth), which fits into a corresponding recessed groove along the top and bottom of the container.

The container is similar in construction to those widely used in the fast-food hamburger industry. It can be sealed by employing two "tab into slot" locking assemblies molded into its sides. Once sealed as such, the container can be easily removed from the rest of the device by squeezing the handles together to open the jaws. With the locking assemblies now holding the container closed, the motion of opening the jaws serves to disengage the jaws' "teeth" from the grooves on the container, allowing the container to be simply dropped into a proper waste receptacle. Latching the used container and positioning a new container in the jaws is the closest the user need come to the waste materials.

Embodiments of the invention permit the user to open the waste container, thus readying it for collection, by squeezing the two handles together. This action depresses a rod located inside the length of the shaft and connected at the other end to the hinge mechanism of the jaws. Each jaw is held in place by one side of a surrounding, fixed, Y-shaped armature, mounted orthogonally to the jaws' hinge, and a rigid link member pivotably connected between the end of the armature and the outer side of the jaw. Pressure on the hinge forces the jaws forward, while the armature and its attached members combine to translate the motion to open the jaws. The container held by the jaws also opens. The operator is now able to use the open container to collect pet waste.

When pressure on the handle grips is released, a spring inside the shaft withdraws the rod and closes the jaws and the container until needed again. The collected waste is held securely and safely inside the container. The pet owner has to only secure the locking assemblies on either side of the container, open the jaws, and drop it in a convenient waste receptacle.

Ease of installation and ejection of the disposable container in the implement of the present invention is facilitated by a particular structural configuration of the preferred embodiment of the container disclosed herein. The rearward face of the recess or pocket of the container which is formed to receive the protrusion extending from each jaw of the implement is relieved slightly at points cross the surface, leaving a thin, irregular zig-zag or "washboard" appearance. Since the container is fabricated of foamed polyurethane or similar crushable material, installing a fresh container in the jaws of the collection implement results in a slight crushing of the outer portions of the relieved surface of the pockets. Very little force is required to produce this deformation, which advantageously compensates for manufacturing tolerances of the dimensions of the mating portions of the container and the jaws of the implement. The result is a snug fit of the container into the jaws with very easy release thereof when the container is closed for ejection from the implement.

BRIEF DESCRIPTION OF THE DRAWING

A better understanding of the present invention may be realized from a consideration of the following detailed description, taken in conjunction with the accompanying drawing in which.

DESCRIPTION OF THE PREFERRED EMBODIMENT

Figure 1:
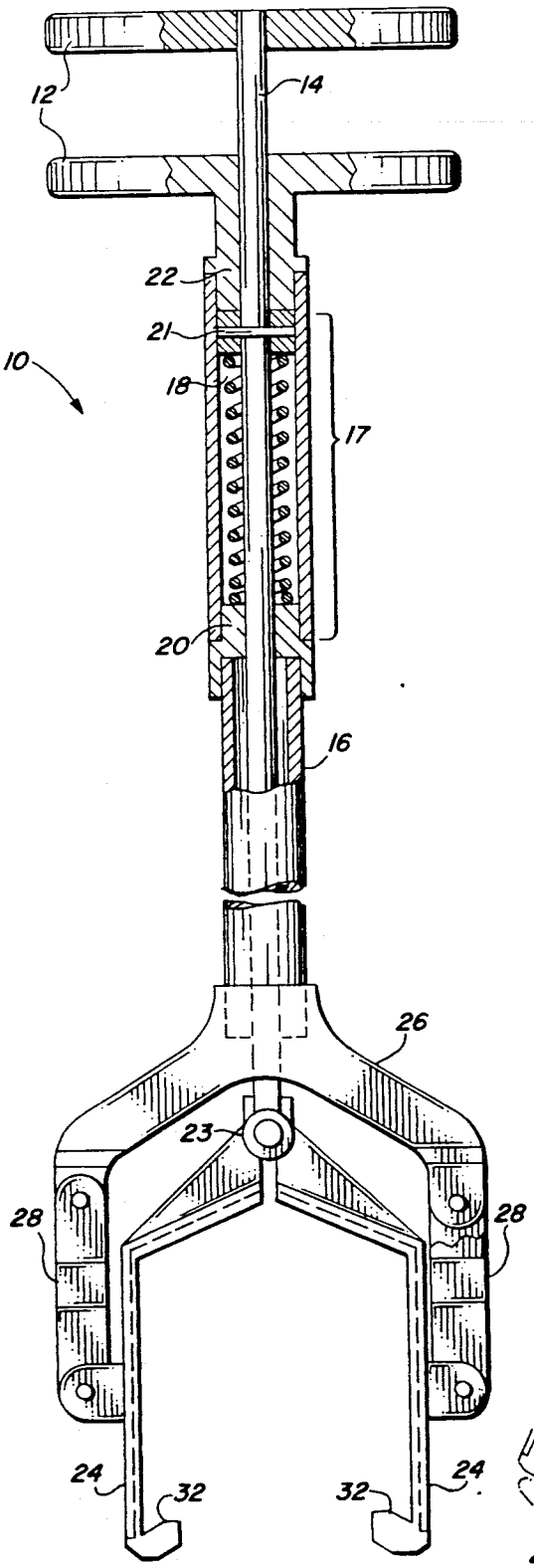
FIG. 1 is a schematic side view, partially broken away, of one particular arrangement in accordance with the invention.
Figure 2:
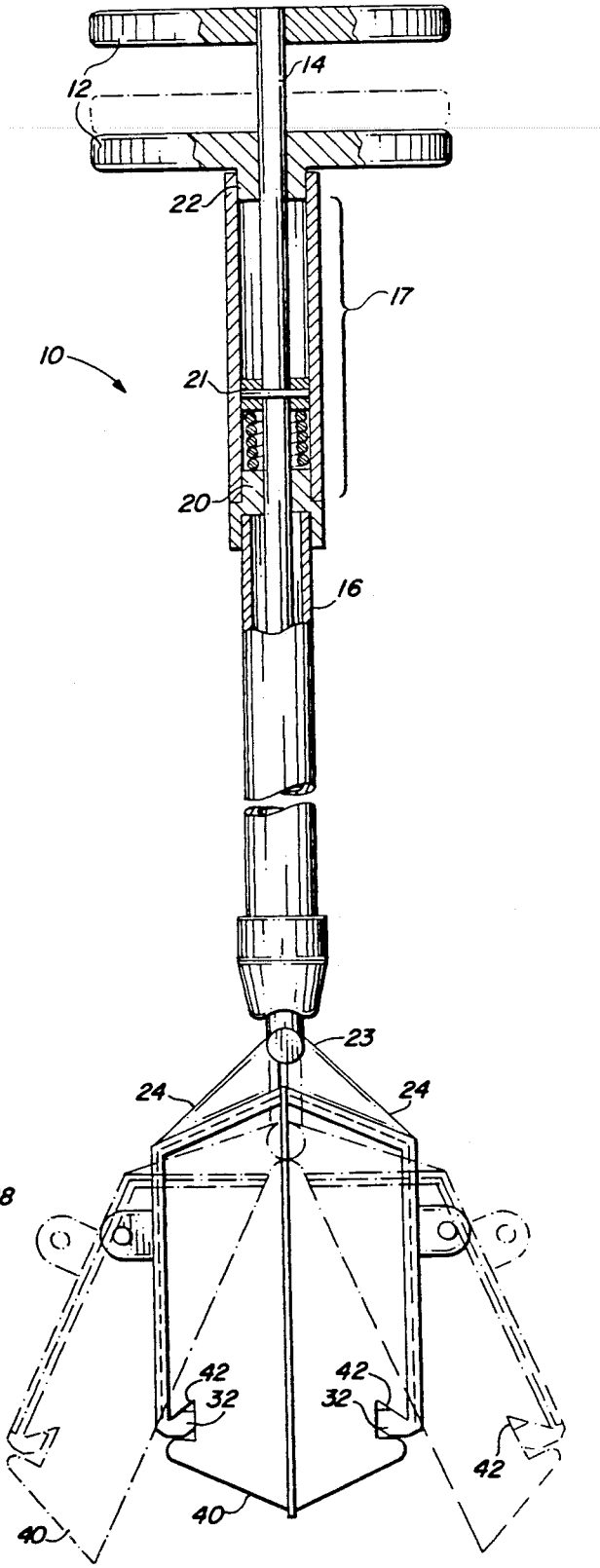
FIG. 2 is a schematic side view, partially broken away, of the apparatus of FIG. 1 showing the collector portion in the closed and, in phantom, the open positions.

In FIGS. 1 and 2, an implement 10 embodying the present invention is shown, comprising a pair of handles 12, one of which is attached to a plunger rod 14 running down the center of the main shaft 16. Contained inside the shaft 16 is a spring assembly 17 comprised of a spring 18 and a pair of spring stops 20 and 21, designed to return the handles 12 to the position shown in FIG. 1. The spring stop 20 is attached to the main shaft 16, while spring stop 21 is affixed to the plunger rod 14. An end cap 22 limits the return travel of the plunger rod.

At the opposite end of the rod 14 is attached a hinge 23 for a pair of jaws 24. A rigid, Y-shaped armature 26 and rigid bifurcated link members 28 support and align the jaws. The link members 28 are pivotably mounted at both ends, where attached to the end of the fixed armature 26 and where attached to the outside of the jaws 24. Each jaw 24 has an outwardly protruding element for connecting to an associated link member 28. Each jaw 24 has along its outer edge a ridge 32 angled inward to hold a disposable container 40 in place for manipulation. The size and angle of the ridges 32 have been exaggerated for detail.

FIG. 2 shows the operative elements of the implement 10 with the disposable container 40 in place in both the closed position (solid outline) and open position (broken line outline). The armature 26 and link members 28 have been omitted for clarity. The container 40 has, molded into its top and bottom surfaces, grooves 42 corresponding in shape to the angled ridges 32 on the inner faces of the jaws 24. These ridges 32 and grooves 42 interlock to allow the jaws 24 a grip sufficiently tenacious to open and close the container 40 easily while still permitting the release of the container from the jaws under appropriate circumstances.

Figure 3:
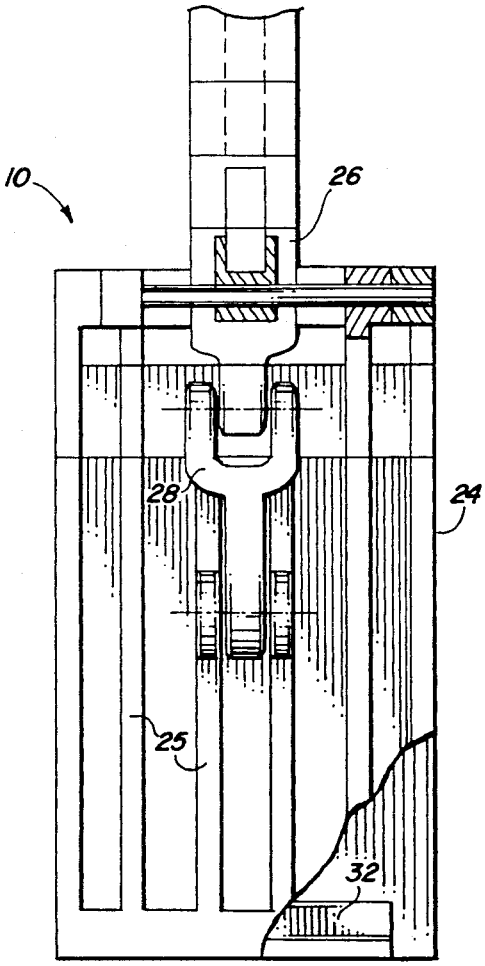
FIG. 3 is a top view, partially broken away, of the jaw assembly of the apparatus of FIG. 1.

FIG. 3 shows one possible configuration of the implement 10 for the attachment of the armature 26, link member 28, and jaw 24. It also shows, in breakaway, a possible positioning of the location of the angled ridge 32 inside the jaws 24. Ridges 25 are molded along the outer surface of the jaws 24 for reinforcement.

Figure 4:
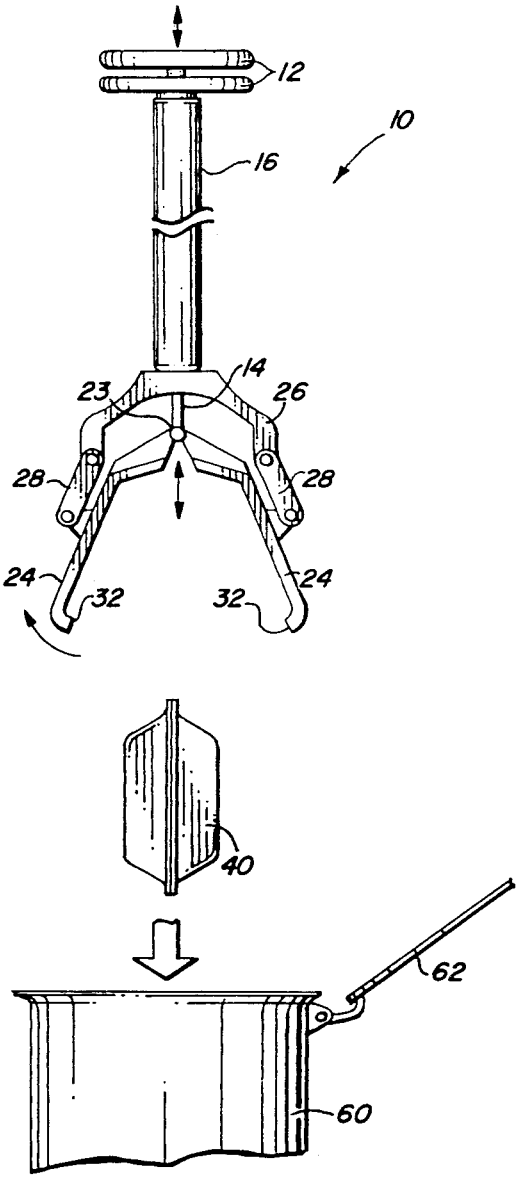
FIG. 4 is a view depicting disposition of a filled container by ejection from the apparatus of FIG. 1.

FIG. 4 is a schematic view illustrating the disposition of a container after it has been used in the implement 10 for picking up various residues. Following the collection mode, the edges of the container 40 are secured together in a manner which will be described hereinafter. The combination of implement 10 and container 40 is then strategically positioned over a garbage can and/or some other waste receptacle, here designated by the reference numeral 60 with the lid 62 open, and the handles 12 are squeezed together. This extends the internal shaft 14 and attached hinge member 23. The interconnection of the fixed armature 26, link members 28 and jaws 24 forces the jaws to their open position. Since the container 40 is sealed closed, the ridges 32 withdraw from the grooves in the container 40, and the container is released to drop in the trash container 60. Thus, the generally disagreeable task of collecting animal residues and disposing of them properly is rendered less unpleasant by the use of arrangements in accordance with the use of the present invention. There is now no need to touch any residue being collected, and the collection container can also be disposed of in a neat and sanitary manner without any handling of the collected residues. The entire process from pick -up to disposal is conducted at arms' length distance.

Figure 5:
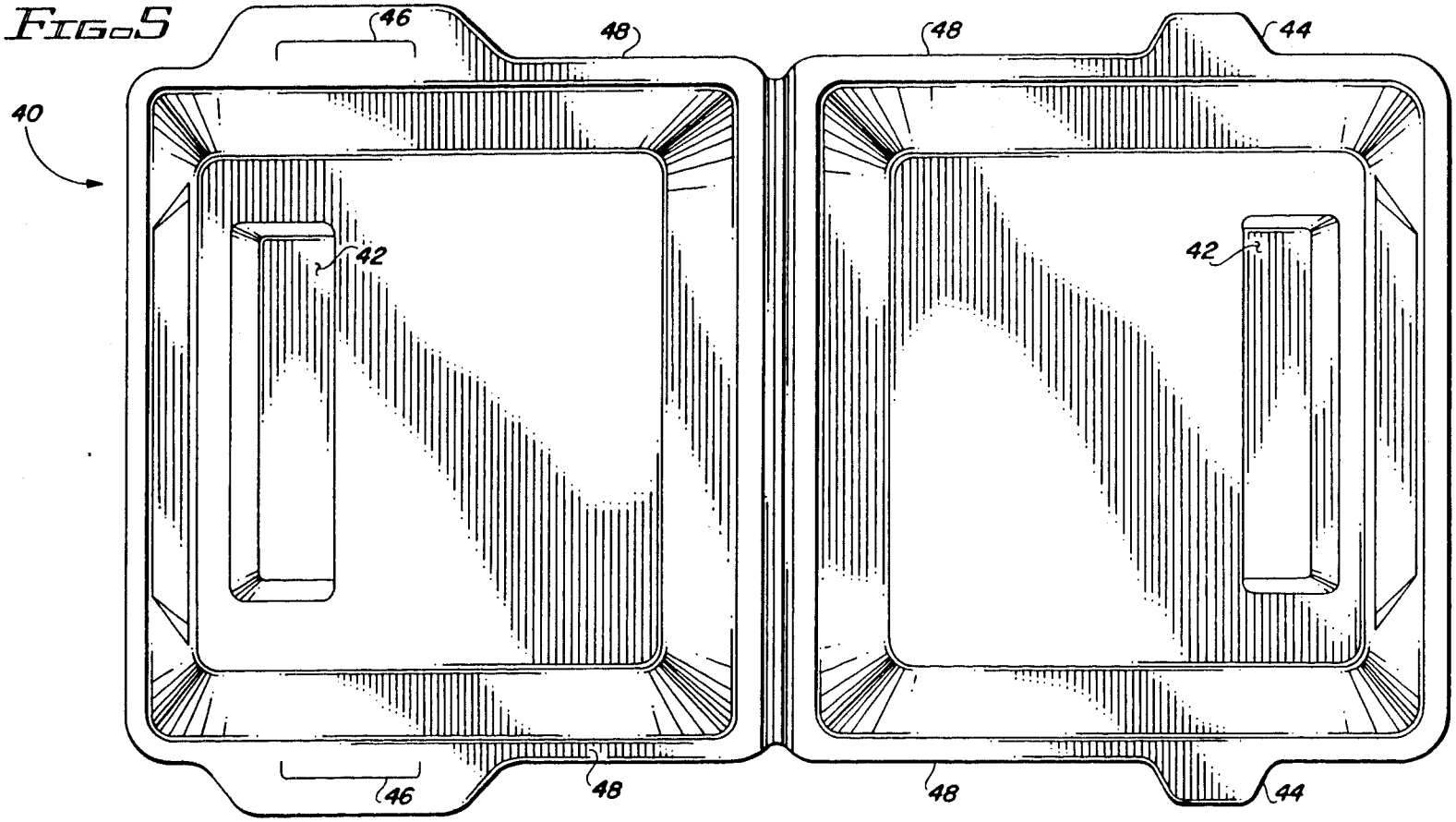
FIG. 5 is a plan view of one particular arrangement of a disposable container for use with the arrangement of FIG. 1.

FIG. 5 shows a possible configuration for the construction of the disposable container 40. Tabs 44 and corresponding slots 46 have been designed into the molded lips 48 constituting the boundary of the container halves, permitting the container 40 to be latched closed after use. In a preferred embodiment, the container 40 is molded of a foamed polyurethane which renders the container cheap to manufacture, lightweight, and stackable to facilitate shipping and storage in bulk, and sufficiently rigid for the purpose here intended. Such a container very closely resembles the containers used for packaging hamburgers and other sandwiches in the fast food industry. Also shown is a possible location of the grooves 42 in the surfaces of the container 40.

Figure 6:
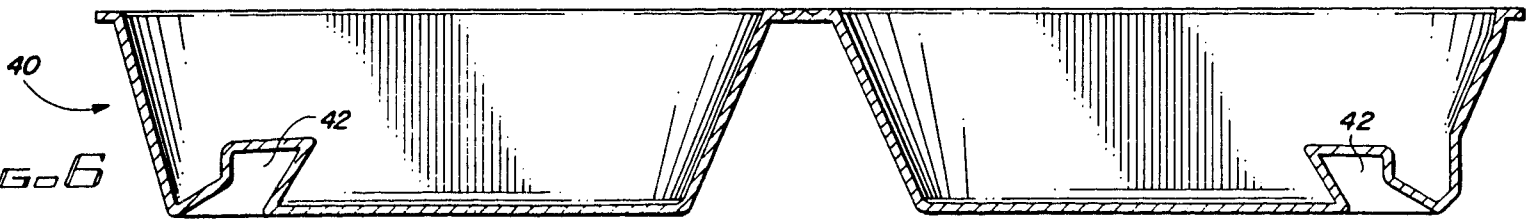
FIG. 6 is a side view, seen in cross-section, of the container of FIG. 5.

FIG. 6 shows, in cross section, one possible configuration of the grooves 42 in the surfaces of the container 40. The shape of these grooves 42 is designed to correspond in mating relationship with the shape of the ridges 32 on the inside of the jaws 24 (FIGS. 1 and 2). The size and angle of these grooves 42 have been exaggerated for detail.

Figure 7:
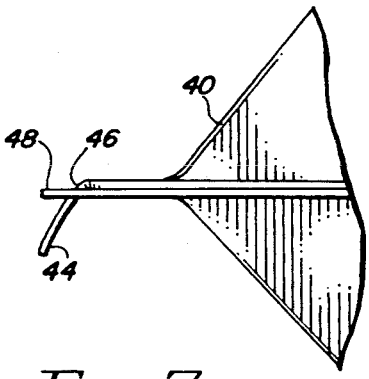
FIG. 7 is a partial view showing one closure of the container of FIGS. 5 and 6.
Figure 8:
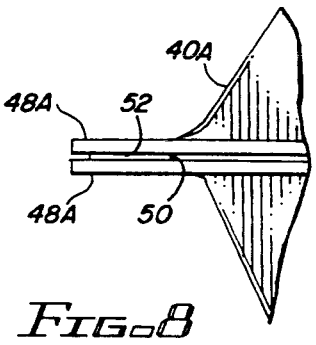
FIG. 8 is a partial view showing an alternative closure for the container of FIGS. 7 and 8.

FIGS. 7 and 8 illustrate particular details of two alternative arrangements for sealing the container 40 when it is ready for disposal. The arrangement depicted in FIG. 7 corresponds to the container shown in FIG. 5, wherein the two halves of the container 40 are latched together by inserting the tongue 44 through the slit 46 in the edge 48. FIG. 5 shows a pair of these latching arrangements on opposite sides of the container 40; if need be for added security, additional pairs of interlocking members may be provided about the periphery of the two halves of the container 40.

FIG. 8 shows a container 40A having boundary edges 48A arranged to be sealed together by adhesive. An adhesive layer 50 is affixed along the lower boundary edge 48A covered with a release liner in the form of a protective strip or tape 52. This release tape 52 is removed by peeling away from the adhesive layer 50 when the container is ready to be sealed closed in preparation for disposal. The adhesive layer 50 then adheres to both the edges 48A and secures them together. The adhesive layer 50 and release liner 52 may be positioned substantially about the periphery of the container 40 or, if desired, it may be positioned as a series of individual strips, approximately one to two inches in length, spaced about the periphery of the container.

Figure 9:
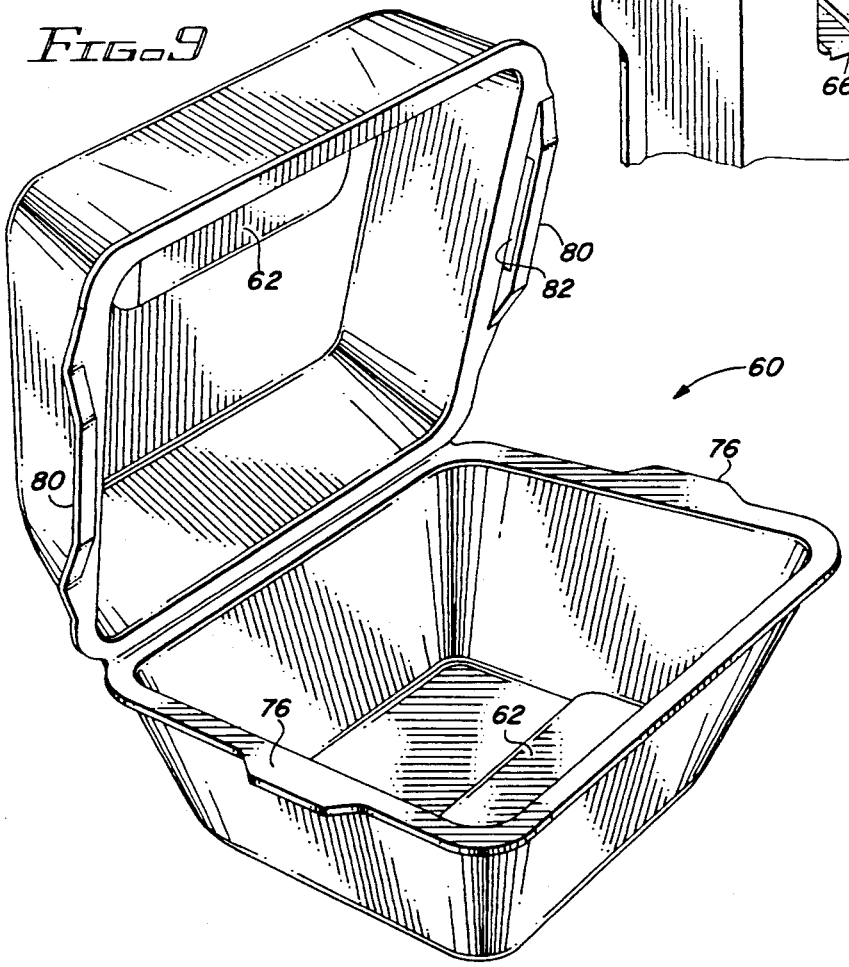
FIG. 9 is a perspective view of an alternative arrangement of the disposable container for use with the implement of FIG. 1.
Figure 10:
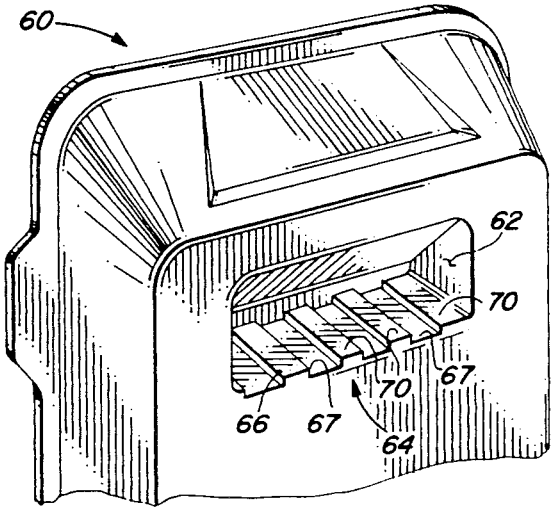
FIG. 10 is a view of a portion of the container of FIG. 9, showing the arrangement prior to installation in the implement of FIG. 1.
Figure 11:
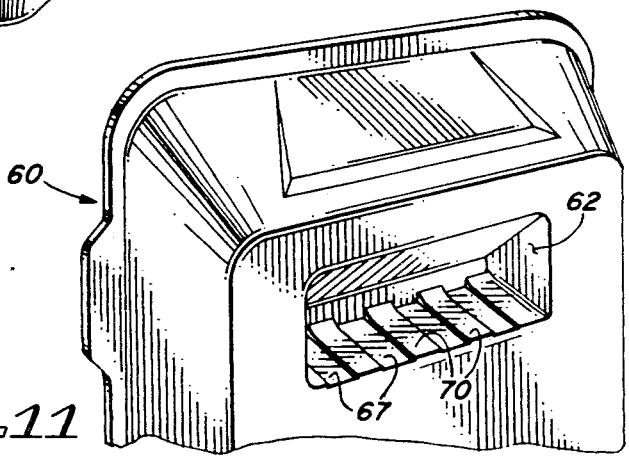
FIG. 11 is a view similar to that of FIG. 10 showing the same portion of the container after it has once been installed in the implement of FIG. 1.

The alternative embodiment of a container 60 which is depicted in FIGS. 9–11 presents particular structural feature which improves the operation of the device and the facility with which the disposable container may be installed and ejected. Like the container depicted in FIGS. 5 and 6, container 60 is formed with pockets 62 for receiving the projecting ridges 32 on the inner sides of the jaws 24 (FIGS. 1 and 2). Each pocket 62 has a region 64 (best seen in FIG. 10) along its rearward face 66 which is relieved at intervals 67 to form a series of corrugations 70 (the rearward face of the pocket 62 is that which is nearest the hinge 23 of the jaws 24).

For the combination of the present invention to perform effectively, a close fit is required between that portion of each half of the container extending between a pocket 42 or 62 and the container hinge and the mating portion of the jaws 24 extending between a ridge 32 and the jaw hinge 23. The fit must be tight enough that the container halves are held by the jaws to open and close therewith but not so tight that the container does not release readily when its edges have been latched together in preparation for ejection and disposal. It has been found that the necessary tolerance limits required for the variations in dimensions of the implement jaws and the container, both of which are manufactured in different factories by different vendors, are rather extreme and sometimes result in an interference fit between the mounting ridges of the jaws and the pockets of the disposable containers. This makes it difficult both to install the container in the implement and to eject the container from the implement after it has been filled with picked-up wastes.

The container 60 of FIGS. 9–11 alleviates these problems by the inclusion of the corrugations 70 along the rearward face of the pockets 62. FIG. 11 shows how the corrugations 70 between the relieved sections 67 deformed from the container 60 having been installed in an implement in which the dimension between the mounting ridge and the jaw hinge is slightly less than the corresponding dimension of the container 60 as fabricated. The corrugations of the foamed plastic material are crushed and deformed to the extent necessary to permit the container 60 to be installed. The result is a sufficiently tight fit to maintain the container operable between opened and closed positions as the jaws are opened and closed, while still enabling the container when latched closed to be ejected readily from the implement.

The container 60 is provided with opposed latching tongues 76 and ears 80 with slits 82. When ready for disposal, the closed container is merely squeezed inwardly on the sides bearing the tongues 76 until they clear the ears 80 so that upon release they enter the slits 82, thus latching the container closed. Actuating the implement 10 to open the jaws 24 then releases the latched container in the manner illustrated in FIG. 4.

Although there have been described hereinabove specific arrangements of a manual collection apparatus in accordance with the invention for the purpose of illustrating the manner in which the invention may be used, it will be appreciated that the invention is not limited thereto. Accordingly, any and all modifications, variations or equivalent arrangements which may occur to those skilled in the art should be considered within the scope of the invention as defined in the appended claims.

What is claimed is:

1. In combination, a disposable container and handheld apparatus for collecting and disposing of solid pet wastes in said container, said apparatus comprising:

a pair of pivoted jaws having means for releasably retaining said container; said means including a pair of opposed protuberances, each being located along the inner surface of a corresponding one of said jaws and projecting inwardly therefrom, each protuberance having an inclined face on the side nearest the point where the jaws are pivoted, said face extending at an acute angle from said inner surface of said corresponding jaw;

a frame member pivotably coupled to said jaws to move the jaws between open and closed positions;

a plunger rod mounted for longitudinal sliding movement relative to the frame member, said rod being coupled to the jaws and adapted to move between extended and retracted positions corresponding to the open and closed positions of the jaws;

a pair of handles affixed respectively to the frame member and the rod for facilitating relative longitudinal movement between the frame member and rod; and a spring assembly coupled between the rod and the frame member to bias the rod and said jaws toward one of said open and closed positions; and said disposable container comprising:

a pair of generally symmetrical, clamshell-shaped halves joined together by a flexible hinge and defining a hollow space when in the closed position;

means for latching said halves together in the closed position during release of said container halves from said jaws;

each container half including a formed recess shaped to releasably engage a mating protuberance located along the inner surface of a corresponding jaw of said apparatus, each formed recess including an inclined wall extending at an acute angle from the bottom of the recess to match the angle of said face of a corresponding protuberance;

whereby the two halves of the container, when mounted within said jaws, are releasably gripped by the jaws to open and close with said jaws when the latching means are not engaged and to release from said jaws as the jaws are driven to the open position when the two container halves are held together by said latching means.

2. The combination of claim 1, said apparatus further including a hinge mechanism pivotably coupling said jaws to said rod at one end thereof to permit the jaws to open as the rod is extended relative to the frame member.

3. The combination of claim 2, said apparatus further including means affixed to the frame member and pivotably coupled to the jaws to facilitate movement of the jaws to the open position as the rod is extended relative to the frame member.

4. The combination of claim 3 wherein said affixed means comprise a Y-shaped armature mounted on the frame member and a pair of pivoted links extending between the opposite branches of the Y-shaped armature and connection points positioned along the outer surface of the jaws.

5. The apparatus of claim 4 wherein the connection points comprise a pair of outwardly protruding elements, one for each jaw, generally centrally located along said outer surface.

6. The combination of claim 4 wherein the frame member comprises a shaft having a hollow bore and wherein the plunger rod is mounted for sliding movement within said bore.

7. The combination of claim 6 wherein the spring assembly comprises a compression spring mounted within said shaft and biasing the rod to open said jaws.

8. The combination of claim 1 wherein said container is made of deformable material and includes said recesses for matingly receiving said protuberances and wherein said protuberances develop an interference fit with sides of said recesses, thereby deforming said container for improved engagement with said protuberances.

9. The combination of claim 8 wherein the container is formed of foamed polyurethane in a shape defining said recesses as an inwardly directed pocket in each half of the container, said pocket having a rear wall which includes a plurality of deformable corrugations which are crushable when a mating protuberance is pressed into the pocket.

10. The combination of claim 1 wherein said means for latching, when engaged, hold the container closed with sufficient force to disengage the jaws from the container, thereby automatically ejecting the container from the jaws as the plunger rod is moved in the direction to open said jaws.

11. The combination of claim 1 wherein the container is formed with an extended boundary edge along at least a portion of each half, which edge includes said latching means as a plurality of spaced, actuatable, retaining elements for maintaining the container closed against the grip of said jaws as the jaws are opened when said retaining elements are actuated.

12. The combination of claim 11 wherein each retaining element comprises a tongue and slit ear combination which is latchable by squeezing the container to insert the tongue into the slit of said slit ear.

13. The combination of claim 11 wherein the retaining elements comprise an adhesive strip situated between said edges and protected by a removable release liner.

* * * * *